US006152786A

United States Patent [19]

Perrin et al.

[11] Patent Number: 6,152,786

[45] Date of Patent: Nov. 28, 2000

[54] ONE-PIECE INSULATION PIERCING INSERT

[75] Inventors: Albert Renaud Perrin, Newmarket; Roland Sion Timsit, North York, both of Canada

[73] Assignee: The Whitaker Corporation, Wilmington, Del.

[21] Appl. No.: 09/298,569

[22] Filed: Apr. 23, 1999

[51] Int. Cl.[7] ..... H01R 4/50

[52] U.S. Cl. ..... 439/783; 439/417

[58] Field of Search ..... 439/783–785, 439/790, 863, 433, 435, 436, 425, 429, 393, 417, 413, 426

[56] References Cited

U.S. PATENT DOCUMENTS

| | | | |
|---|---|---|---|
| 3,123,662 | 3/1964 | Fink . | |
| 3,188,380 | 6/1965 | Lorenz . | |
| 3,329,928 | 7/1967 | Broske . | |
| 3,848,956 | 11/1974 | Kraft . | |
| 5,006,081 | 4/1991 | Counsel et al. | 439/783 |
| 5,816,865 | 10/1998 | Chadbourne | 439/783 |
| 5,842,893 | 12/1998 | DeKeyser . | |
| 5,916,001 | 6/1999 | Chadbourne | 439/783 |

FOREIGN PATENT DOCUMENTS

| | | |
|---|---|---|
| 18034/92 | 7/1993 | Australia . |
| 0810687A1 | 3/1997 | France . |
| 2272799A | 5/1994 | United Kingdom . |

*Primary Examiner*—Neil Abrams
*Assistant Examiner*—J. F. Duverne
*Attorney, Agent, or Firm*—Michael Aronoff

[57] ABSTRACT

An electrical connector assembly having one-piece intermediate member (24, 24') and method of forming thereof are disclosed. In one embodiment, the one-piece intermediate member (24, 24') includes insulation-piercing serrations that provide for electrical conductivity between two electrical conductors. In another embodiment, the one-piece intermediate member (24, 24') provides for electrical conductivity between an insulated conductor and an uninsulated conductor. Intermediate member (24) includes movable sections (41) located inwardly from cable-engaging sections (40), with piercing serrations (46) extendable outward through slots (48) of the cable-engaging sections so as to penetrate the cables' insulation. In another embodiment, the electrical conductivity between the two electrical conductors is provided by a C-shaped receptacle element of the connector assembly. In all embodiments, the piercing serrations rigidly fix the electrical connection of the electrical conductors.

9 Claims, 8 Drawing Sheets

ONE-PIECE INSULATION PIERCING INSERT

FIELD OF THE INVENTION

The invention is directed to an electrical connector assembly with a one-piece member for piercing electrical insulation of electrical conductors and establishing electrical connection between the electrical conductors.

BACKGROUND OF THE INVENTION

Electrical connectors having an electrically conductive piercing serrations, sometimes referred to herein as piercing members, penetrating means or means for piercing, for piercing the electrical insulation of electrical cables having an electrically conductive core therein so as to establish an electrical connection between conductors of different electrical cables are known and one such electrical connector is disclosed in U.S. Pat. No. 5,842,893 ('893) issued Dec. 1, 1998. The electrical connector of the '893 patent comprises a C-shaped receiver element, an intermediate member having opposed sections with piercing members running along opposed outwardly facing surfaces, and a wedge member that has dimensions so as to be inserted between the opposed sections and in so doing, forcing the piercing members through electrical insulation and into the cores of the different cables being electrical connected by the electrical connector of the '893 patent. It is desired that a more simplified electrical connector be provided, especially with regard to the piercing serration, and the method of manufacture thereof. It is further desired that the simplified electrical connector have features that render it more versatile. Further, it is desired to provide an electrical connector that accommodates both insulated and uninsulated cables.

The electrical connector assembly of the present invention, in one embodiment, provides for electrical connection between insulated conductors and does so with an implementation of a one-piece piercing member that is easily fabricated and yet provides a piercing function by cutting through the insulation of electrical conductors and establishing electrical connection therebetween. In another embodiment, an electrical connector assembly is provided for electrical connection between insulated and uninsulated conductors and does so with an implementation of a one-piece piercing member having piercing serrations on only one of its sides and that is easily fabricated.

SUMMARY OF THE INVENTION

The invention is directed to an electrical connector assembly for connecting electrical conductors each having an insulated covering and each containing an electrically conductive core. The connector assembly comprises a receptacle element, a tapered element, and intermediate member having means for piercing. The receptacle element has channels each partially enclosing one of the electrical conductors. The tapered element is suitable for being inserted into the receptacle element. The intermediate member is a one-piece member and, in one embodiment, comprises electrically conductive material and is suitable for being situated between the receptacle element and the tapered element. In other embodiments, the intermediate member, the tapered element and the receptacle element may be comprised of electrically conductive or non-electrically conductive material. The intermediate member has oppositely disposed cable-engaging sections that define outwardly facing surfaces and are complementary to and capable of being accepted by the receptacle element. End portions of the one-piece intermediate member are folded inwardly toward each other and away from the outwardly facing surfaces to form movable sections. Each end portion includes at least one piercing serration and at least one of the cable-engaging section that includes slots extending therethrough to the outwardly facing surfaces associated with each piercing serration and in alignment therewith. The edges of the intermediate member are folded so that upon movement outwardly of the movable sections by the tapered element, each of the piercing serration fits its associated slot and is suitable for piercing the electrical insulation of the electrical conductors. The piercing serrations of the receptacle element and the intermediate members provide a rigidly fixed electrical connection between the electrical conductors, whereas the materials of the receptacle element, the tapered element, and the intermediate member are selected to preferentially direct the current flow between the conductors.

In another embodiment the invention is directed to an electrical connector assembly for connecting two electrical conductors one having an insulated covering and the other being uninsulated. The connector assembly comprises a receptacle element, a tapered element, and intermediate member having means for piercing in one of its cable-engaging sections and the other cable-engaging section being devoid of piercing means.

The present invention also provides a method of forming the intermediate member of the electrical connector assembly. The method comprises steps of providing a plate having oppositely disposed top and bottom portions having unequal lengths and oppositely disposed side portions with edge portions thereat. The edge portions extend upward from the bottom portion. The plate further has at least one penetrating means formed into at least one edge portion and at least one slot separated from the at least one penetrating member by a predetermined distance and parallel with and in alignment with the at least one penetrating means. The method comprises the steps of bending the plate at first two predetermined locations each relative to respective edge portions so as to form first curved portions. The method then bends the plate at two second predetermined locations each relative to respective edge portions so as to form second curved portions. The method continues by bending the plate at two third predetermined locations each relative to respective edge portions so as to form third curved portions that are disposed inwardly from plate portions between the first and second curved portions. The method then grips the at least one penetrating means so as to insert it into a respective slot thereof and so that the separation between the first and second curve portions form a concave surface therebetween.

BRIEF DESCRIPTION OF THE DRAWINGS

The embodiments of the present invention will now be described with reference to the accompanying drawings, in which:

FIGS. 3(A) and 3(B) each illustrate a different embodiment of the receptacle element of FIG. 2 operatively cooperating with the tapered element and intermediate member for preferentially directing current flow between the cables and rigidly fixing the electrical connection of the cables.

DETAILED DESCRIPTION OF THE PREFERRED EMBODIMENTS

Figure 1:
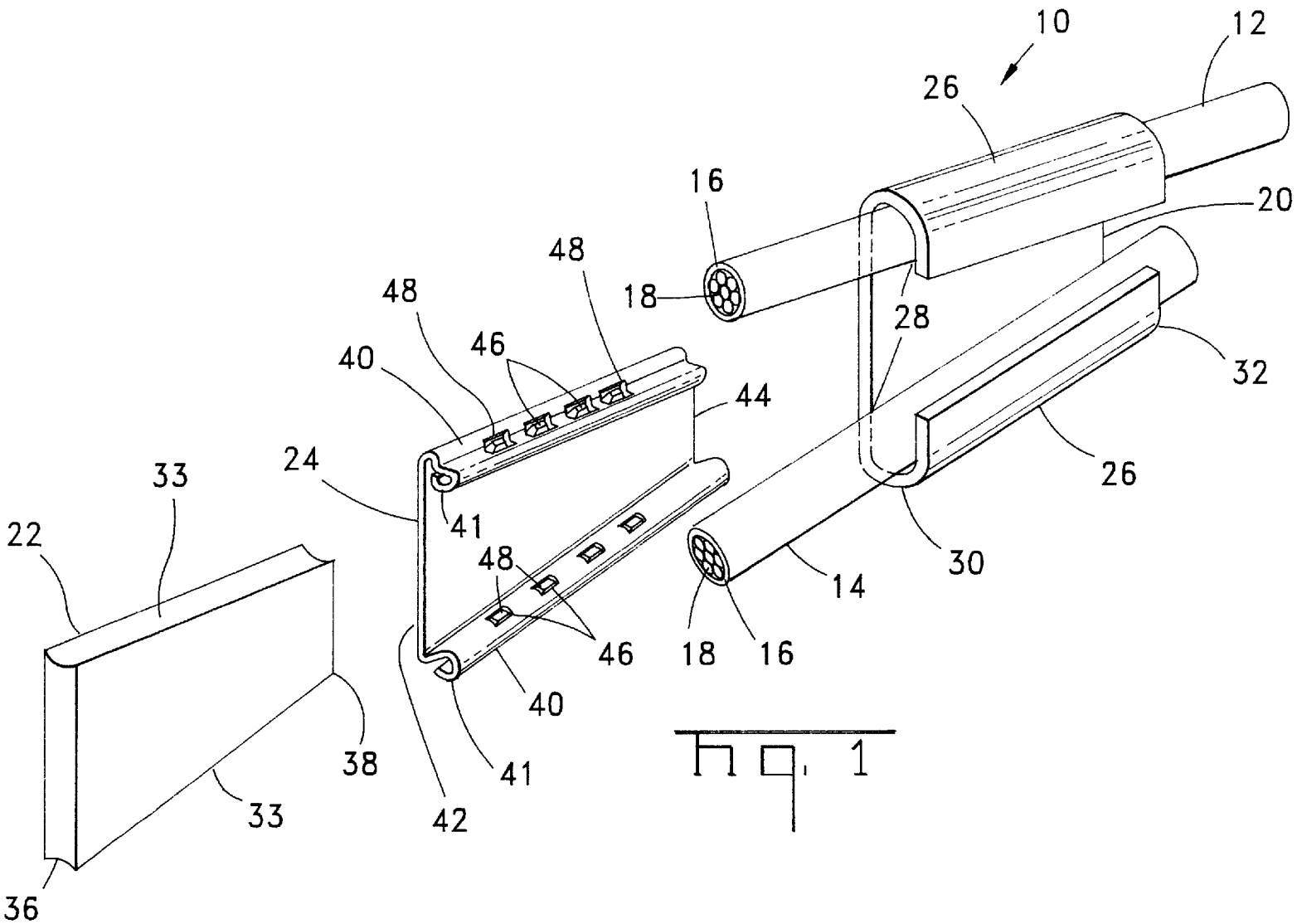
FIG. 1 is an exploded isometric view of the electrical connector assembly of the present invention.

With reference to the drawings, wherein the same reference numbers indicate the same elements throughout, there is shown in FIG. 1 a connector assembly 10 for connecting together electrically conductive conductors 12 and 14 each having an insulation covering 16 and each having an electrically conductive core 18 which may comprise a plurality of electrical conductors. The electrical connector assembly 10 of the present invention finds utilization for existing power sources that require the establishment of electrical continuity between the two electrical conductors such as those shown as cables 12 and 14. The electrical connector assembly 10 comprises a receptacle element 20, a tapered element 22, and a one-piece intermediate member 24 which is of particular importance to the present invention.

The receptacle element 20 has two ears 26 each of which has a channel 28 suitable for partially enclosing a respective electrically conductive conductor 12 and 14. The receptacle element 20 has a front end 30 and a rear end 32 and is contoured so as to converge from the front end 30 toward the rear end 32 with the width of receptacle element 20 correspondingly decreasing therebetween. The receptacle element 20 may have piercing serrations 34 which may be further described with reference to FIG. 2.

Figure 2:
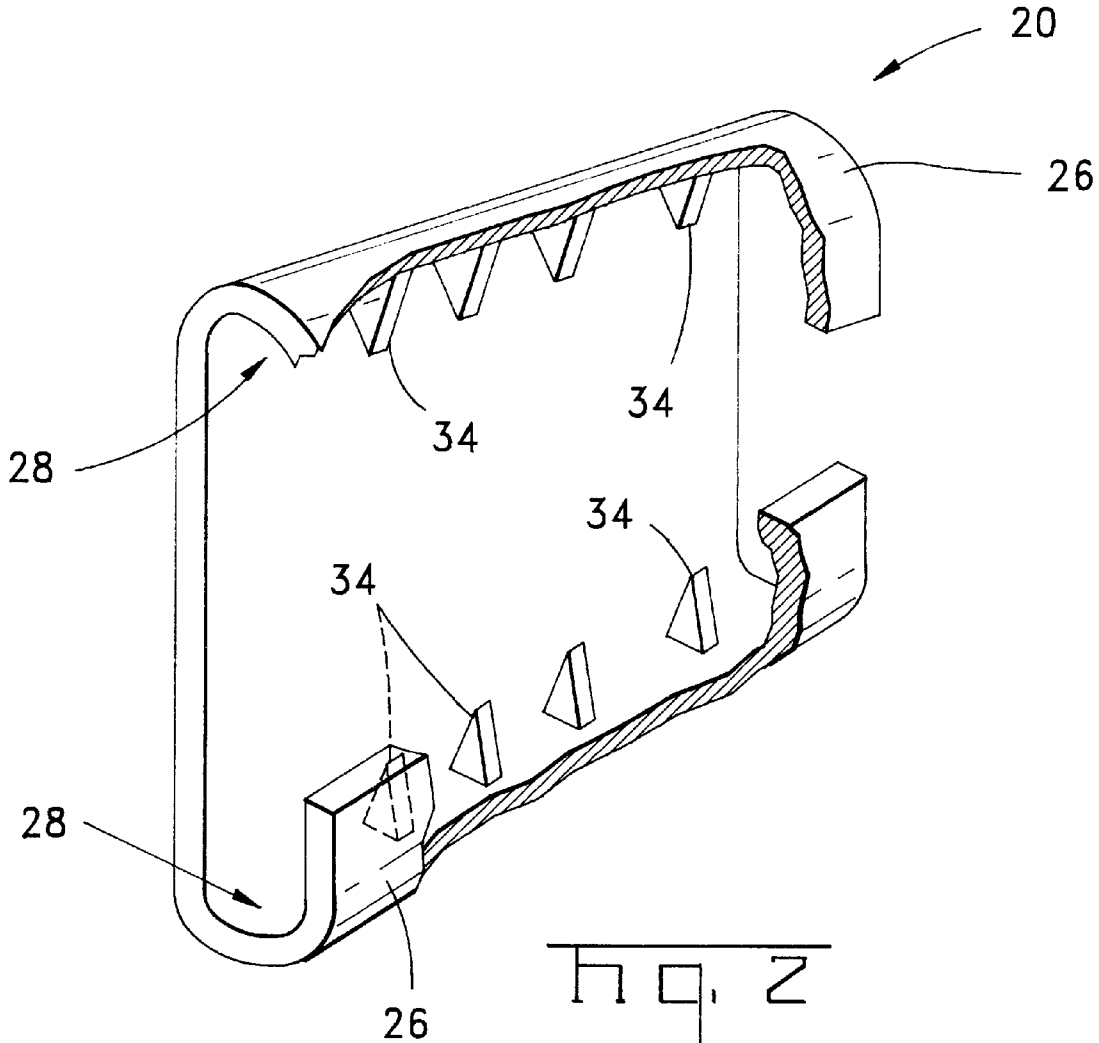
FIG. 2 illustrates the receptacle member of FIG. 1 partially cut away so as to illustrate piercing members thereof.
Figure 7B:
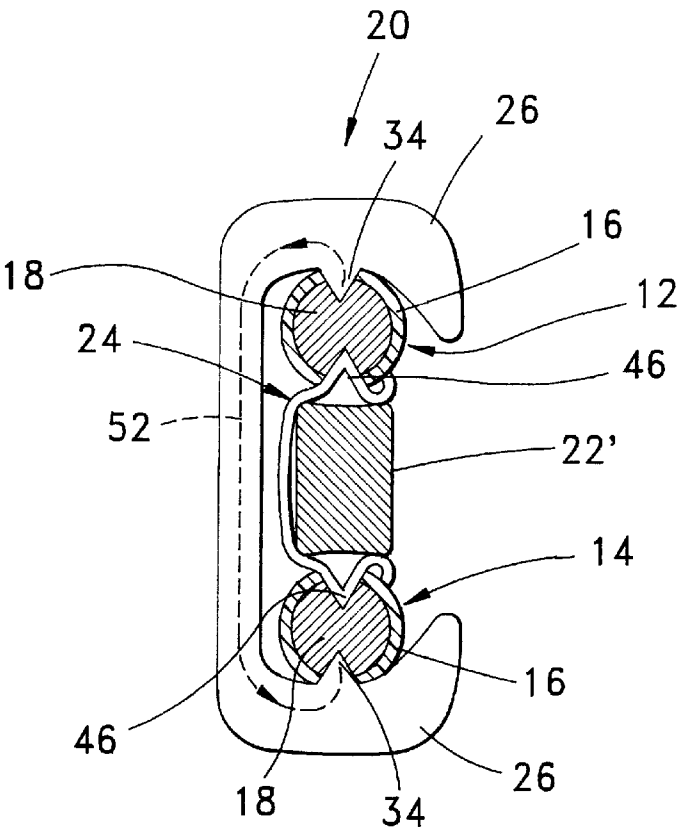
FIG. 7 illustrates the receptacle member of FIG. 6 partially cut away so as to illustrate piercing serrations thereof.
Figure 7A:
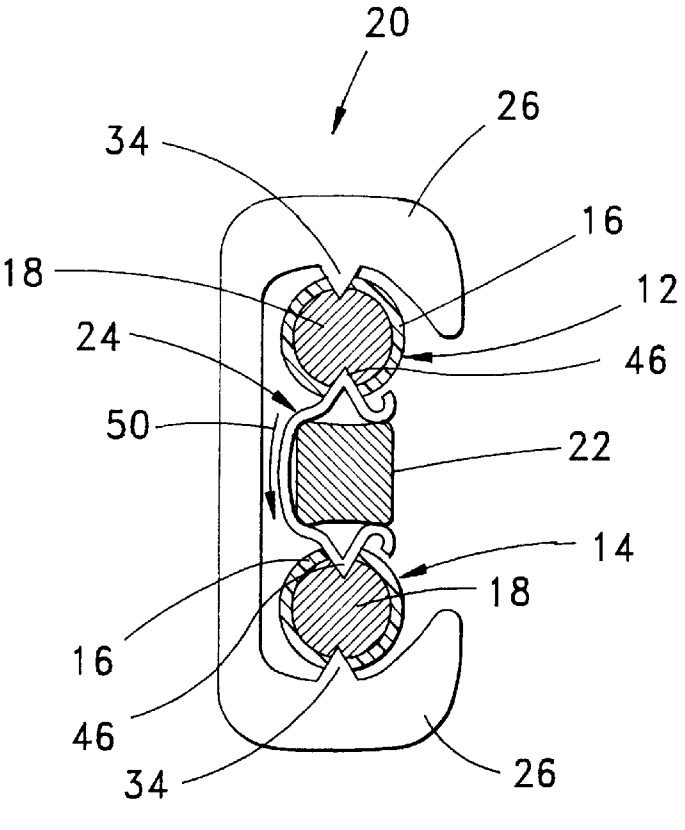

FIG. 2 illustrates the receptacle element 20 as being partially cut away so as to more clearly show the piercing serrations 34 as being located along at least one, but preferably both channels 28. The receptacle element 20 for the embodiment of FIG. 2, and also FIG. 4 to be described, may have at least one but preferably more than one piercing serration 34. The piercing serration 34, as well as the piercing member for the intermediate member 24 to be described, may have different shapes and may be arranged in one or more rows in a manner as more fully described in U.S. patent application Ser. No. 09/9,353 , assigned to the same assignee as the present invention, and herein incorporated by reference.

The tapered element 22, shown in FIG. 1, has two concave side walls 33, a front end 36, and a rear end 38. The tapered element 22 is contoured so as to converge from the front end 36 toward the rear end 38 with the width of the tapered element 22 corresponding by decreasing therebetween. The tapered element 22 is dimensioned so as to be inserted into the one-piece intermediate member 24.

The one-piece intermediate member 24 is dimensioned so as to be situated between the receptacle element 20 and the tapered element 22. The one-piece intermediate member 24 having edges, a front end 42, a rear end 44 and cable engaging sections 40 with outwardly facing surfaces. The one-piece intermediate member 24 is contoured so as to converge from the front end 42 to the rear end 44 with the width of the one-piece intermediate member 24 correspondingly decreasing therebetween. The oppositely disposed cable-engaging sections 40 have edges that are dimensioned so as to be complementary to and capable of accepting the edges 33 of the tapered member 22.

The oppositely disposed cable-engaging sections 40 have end portions that are folded inwardly toward each other and away from the outwardly facing surfaces to form movable sections 41. Each movable section 41 includes at least one piercing serration 46 and at least one slot 48 preferably arranged in parallel with and in alignment with the at least one piercing member 46. The cable engaging sections 40 are folded so that the at least one-piercing member 46 fits into the at least one slot 48 as shown in FIG. 1. The piercing serration 46 of the intermediate member 24 is suitable for piercing the electrical insulation 16 of the electrical cables 12 and 14, so as the piercing serration 34 of the receptacle element 20 of FIG. 2, the piercing serration 46 makes electrical contact with the electrically conductive cores 18 of the cables 12 and 14. The intermediate member 24 operatively cooperates with the receptacle element 20 as well as with the tapered member 22 which may be further described with reference to FIGS. 3(A) and 3(B) which illustrate embodiments which provide for satisfactory electrical connections with cables 12 and 14.

Both of the embodiments of FIGS. 3(A) and 3(B) utilize the receptacle element 20 of FIG. 1 having the piercing members 34. The serrations 34 are preferably arranged to be in alignment with the piercing members 46 of the intermediate member 24 with the piercing serrations 34 and 46 both piercing the insulation 16 of the respective electrical cables 12 and 14. Further, the tapered member 22, shown in cross-hatched, is wedged into the intermediate member 24. Both of the embodiments of FIGS. 3(A) and 3(B) capture the electrical cables 12 and 14 between the piercing serrations 34 and 46 of the receptacle element 20 and the intermediate member 24, respectively, so as to fix the cables 12 and 14 in a stationary position. In the embodiment of FIG. 3(A), electrical current need not pass through the receptacle element 20 and the tapered element 22, but rather current only needs to pass from one cable 12 to the other cable 14 by conduction only through the intermediate member 24. In the embodiment of FIG. 3(A) the piercing serration 34 need not conduct electricity. Instead, the piercing serration 34 penetrates through the conductor insulation 16 to make mechanical contact with the conductor metal body 18. This provides mechanical support directly to the metal conductor body 18. Such mechanical support, coupled with the mechanical support provided by piercing member 46 of the intermediate member 24, minimizes mechanical support by the insulation 16 of the cables 12 and 14. This, in turn, eliminates mechanical flow of the insulation material during service, particularly if the conductor temperature becomes elevated. More particularly, direct mechanical support by the insulation material 16 of the cables 12 and 14 is to be avoided since the insulation material 16 flows particularly if the conductor 18 temperature becomes elevated, or if the interface with the cables 12 and 14 allows mechanical support by the insulation sleeve making up the insulation 16. Flow of insulation material 16 would lead to loss of mechanical load at the electrical interfaces in the cables 12 and 14, thus leading to a potential degradation of the connector performance. More particularly, the piercing serration-to-metal conductor 18 contact provided by the piercing serrations 34 and 46 biting into the electrical conductors 18 should be used to provide the desired mechanical load bearing function so as to avoid degradation of the connector performance. In the embodiment of FIG. 3(A), the current flowing in direction 50 may also pass through the tapered element 22 if the tapered element 22 is selected to be of an electrically conductive material in a manner as to be described hereinafter.

In the embodiment of FIG. 3(B), electrical current need not pass through the intermediate member 24 and tapered element 22, but rather current only needs to pass from one cable 12 to the other cable 14 by conduction only through the receptacle element 20 as shown by directional arrow 52. In the embodiment of FIG. 3(B) the piercing serration 46 need not conduct electricity. Instead, the piercing serration 46 penetrates through the conductor insulation 16 to make mechanical contact with the conductor metal body 18. This provides mechanical support directly to the metal conductor body 18. Such mechanical support, coupled with the mechanical support provided by piercing member 34 of the receptacle element 20, minimize mechanical support by the insulation 16 of the cables 12 and 14. This, in turn, eliminates mechanical flow of the insulation material during service, particularly if the conductor temperature becomes elevated in a manner as described for FIG. 3(A). FIG. 3(A) is an embodiment wherein the receptacle element 20 is of non-electrically conductive material so that the electrical connection provided by the operative cooperation of the intermediate member 24 and the receptacle element 20 cause the current to flow between the cores 18 of the electrical cables 12 and 14 by way of the intermediate member 24 comprised of electrically conductive material as indicated by directional arrows 50. As used herein, the terms non-conductive material and non-highly electrically conductive material are meant to mean non-highly electrically conductive material, e.g., steel or electrically insulative material, e.g., non-conductive polymer or ceramic material. For the embodiment of FIG. 3(A), the tapered member 22 may carry current if it is selected to be of a electrically conductive material and, conversely, may not carry current if it is selected to be of a non-electrically conductive material.

FIG. 3(B) illustrates an embodiment wherein the receptacle element 20 is comprised of an electrically conductive material and the intermediate member 24 is comprised of an insulating material. For such a combination, the current flows through the receptacle element 20 and is indicated by directional arrows 52.

The embodiments of FIGS. 3(A) and 3(B) allow for different combinations of the materials selected for the receptacle element 20, the tapered element 22 and the intermediate member 24. More particularly, these embodiments allow one combination of the receptacle element 20 and the intermediate member 24 both being of the electrically conductive material, wherein the current path is provided by both the intermediate member 24 illustrated by directional arrows 50 and also by the receptacle element 20 indicated by directional arrow 52. Another combination wherein the tapered member 22 is of an electrically conductive material allows the current (flow 50) to pass through the tapered element 22. Similarly, the embodiment of the FIG. 3(A) allows for the intermediate member 24 to be of the conductive material and the receptacle element 20 to be of a non-electrically conductive material. Again, the tapered element 22 of FIG. 3(A) may be selected to be an electrically conductive material so as to share the current flow with the intermediate member 24. Similarly, the embodiment of FIG. 3(B) allows for the receptacle element 20 to be of an electrically conductive material and the intermediate member 24 to be of an insulating material.

In operation, the tapered element 22 has its two concave side walls 33 inserted under the concave cable-engaging sections 40 and when the tapered element 22 receives a sufficient mechanical force, the tapered element 22 is driven into the intermediate member 24 thereby causing the piercing serrations 46 to pierce the electrical insulation 16 of both the cables 12 and 14 and into the electrically conductive cores 18 thereof and may be further described with reference to FIG. 4.

Figure 4:
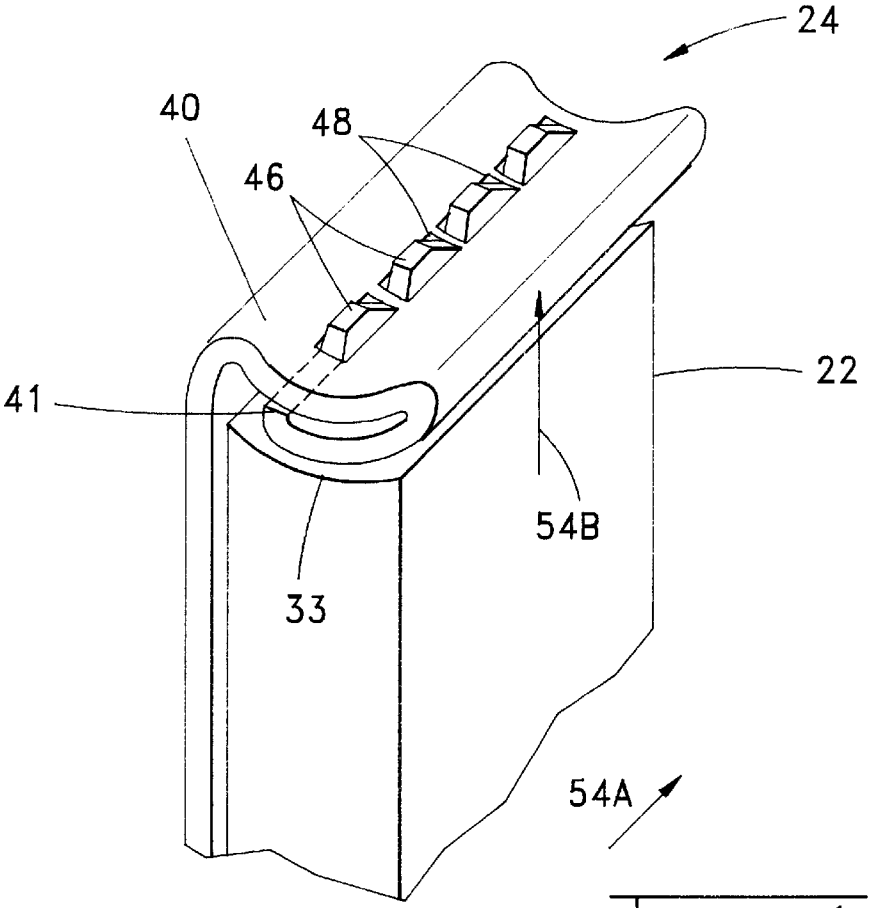
FIG. 4 is an enlarged view of the intermediate member mated with the tapered member of the connector assembly of FIG. 1, as well as that of FIG. 6.

FIG. 4 illustrates one of cable-engaging sections 40 having a concave surface and also illustrates the piercing members 46 being lodged within and spaced apart by the slots 48. Furthermore, FIG. 4 illustrates the tapered element 22 under the cable-engaging section 40 and the concave side wall 33 of the tapered element 22 snugly against the shown cable-engaging section 40.

In operation the tapered element 22 is driven by into the intermediate member 24 in direction 54A causing the tapered element 22 to be moved upward in direction 54B which, in turn, causes the piercing members 46 to be urged outwardly, piercing the electrical insulation 16 of the cables 12 and 14. Although not shown in FIG. 4, it can be seen with reference to FIGS. 3(A) and 3(B) that as electrical cables 12 and 14 are raised upward by the insertion of tapered element 22 and the piercing serrations 34 of the receptacle element 20 of the embodiment of FIG. 2 are driven into the insulation 16 and then into the electrical cores 18 of the electrical cables 12 and 14. The intermediate member 24 is a one-piece device which is of particular importance to the present invention. The one-piece intermediate member 24 may be fabricated in accordance with the practice of the present invention which may be further described with reference to FIGS. 5(A), 5(B), 5(C), 5(D) and 5(E).

Figures 5A, 5B, 5C, 5D, 5E:
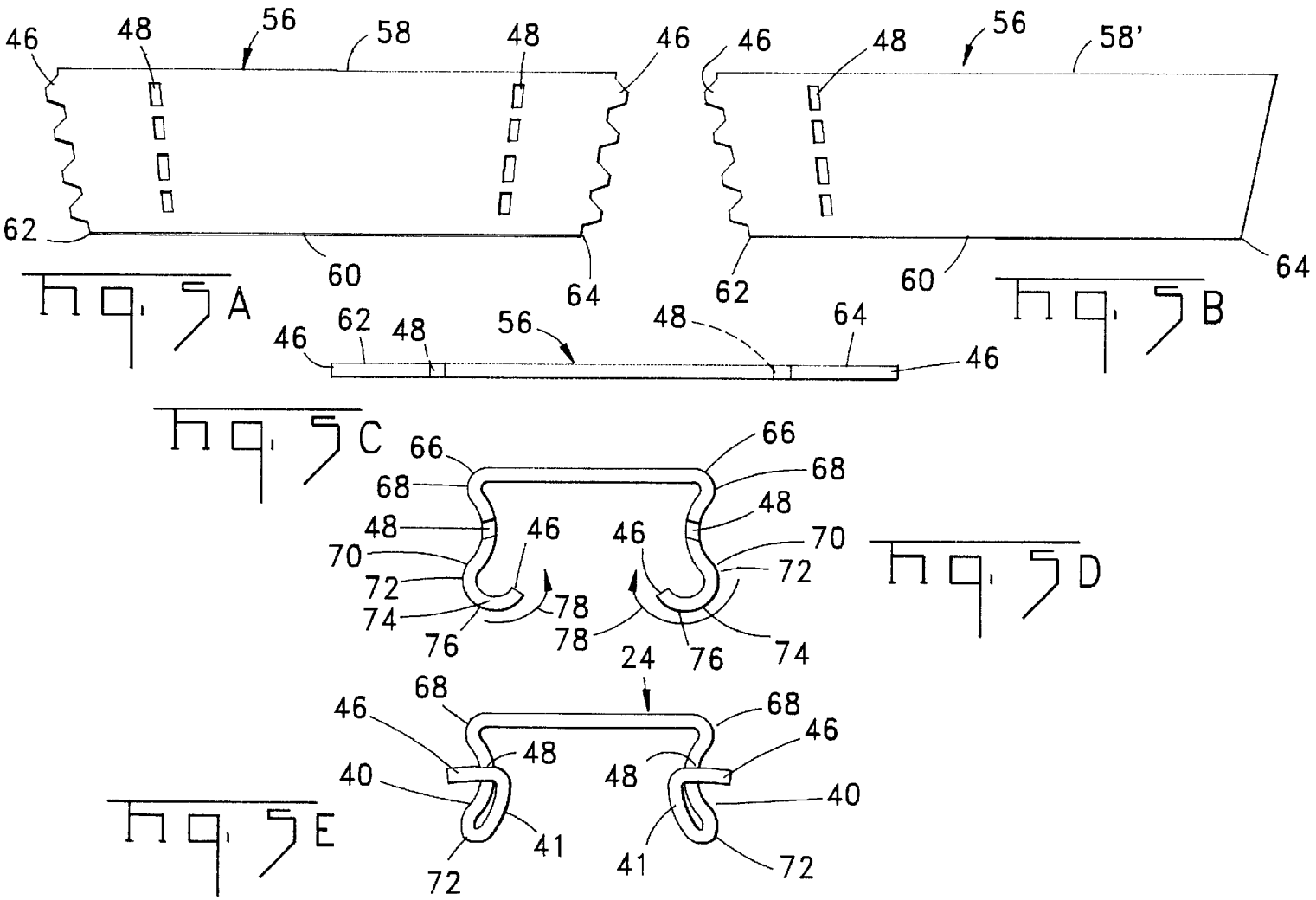
FIGS. 5(A), 5(B), 5(C), 5(D) and 5(E) illustrate sequential steps related to the practice of the present invention.

The method of the present invention for forming the intermediate member 24 is initiated by providing a plate 56 having alternate embodiments shown in 5(A) and 5(B), with the embodiment FIG. 5(A) being preferred and the plate 56 of each embodiment being comprised of an electrically conductive material for use with the arrangement of FIG. 3(A), or of an insulating material for use with the arrangement of FIG. 3(B).

As seen in FIG. 5(A), the plate 56 has penetrating means 46 and slots 48 previously described with reference to FIGS. 1–4. The plate 56 further has oppositely disposed top and bottom portions 58 and 60, respectively, having unequal lengths. The plate 56 further has oppositely disposed side portions 62 and 64 with edge portions thereat that extend upward, at an acute angle, from the bottom portion 60. The plate 56 further comprises at least one piercing serration, but preferably more than one (e.g., four (4)) piercing serration 46 formed in at least one edge portion (See FIG. 5(B)), but preferably at both edge portions 62 and 64 (See FIG. 5(A)). The plate 56 of FIG. 5(B) provides for a further embodiment of the present invention to be further described hereinafter with reference to FIGS. 6–8(B). The plate 56 further has at least one slot 48, but preferably at least four slots 48, separated from the at least piercing serration 46 by a predetermined distance and parallel with and in alignment with the at least one piercing serration 46.

FIG. 5(C) is a view which illustrates the slots 46, and the edge portions 62 and 64 each having a piercing serration 46 at the outermost edge thereof.

FIG. 5(D) illustrates the three bending steps involved with forming the one-piece intermediate member 24 of the present invention. More particularly, FIG. 5(D) illustrates the bending of the plate 56 at two first predetermined locations 66 each relative to the respective edge portions so as to form first curved portions 68. The plate 56 is then bent at two second predetermined locations 70 each relative to the edge portions 62 and 64 so as to form second curve portions 72. The bending is continued so that the plate 56 is bent at two third predetermined locations 74 relative to the edge portions so as to form third curved portions 76 allowing the piercing serration 46 to be raised upward in the directions indicated by directional arrows 78.

FIG. 5(E) illustrates the condition of plate 56 after its piercing serration 46 are gripped and raised upward in directions 78 (FIG. 5(D)) and continuing in the same direction until the piercing serration 46 are inserted into the respective slots 48. After this is accomplished, the separation between the first and second curved portions 68 and 72 (See FIG. 5(D)) forms a concave surface therebetween indicated by the wire-engaging sections 40 movable sections 41 disposed inwardly therefrom. Alternatively, movable sections 41 may be angled sufficiently at curved portion 72 that piercing serration 46 are recessed within or inwardly from slots 48 until being assembled to the cables and urged outwardly by tapered element 22 as shown in FIG. 4. The plate 56 of FIG. 5(B) is used for a further embodiment of the present invention that may be described with reference to FIGS. 6–8(B).

Figure 6:
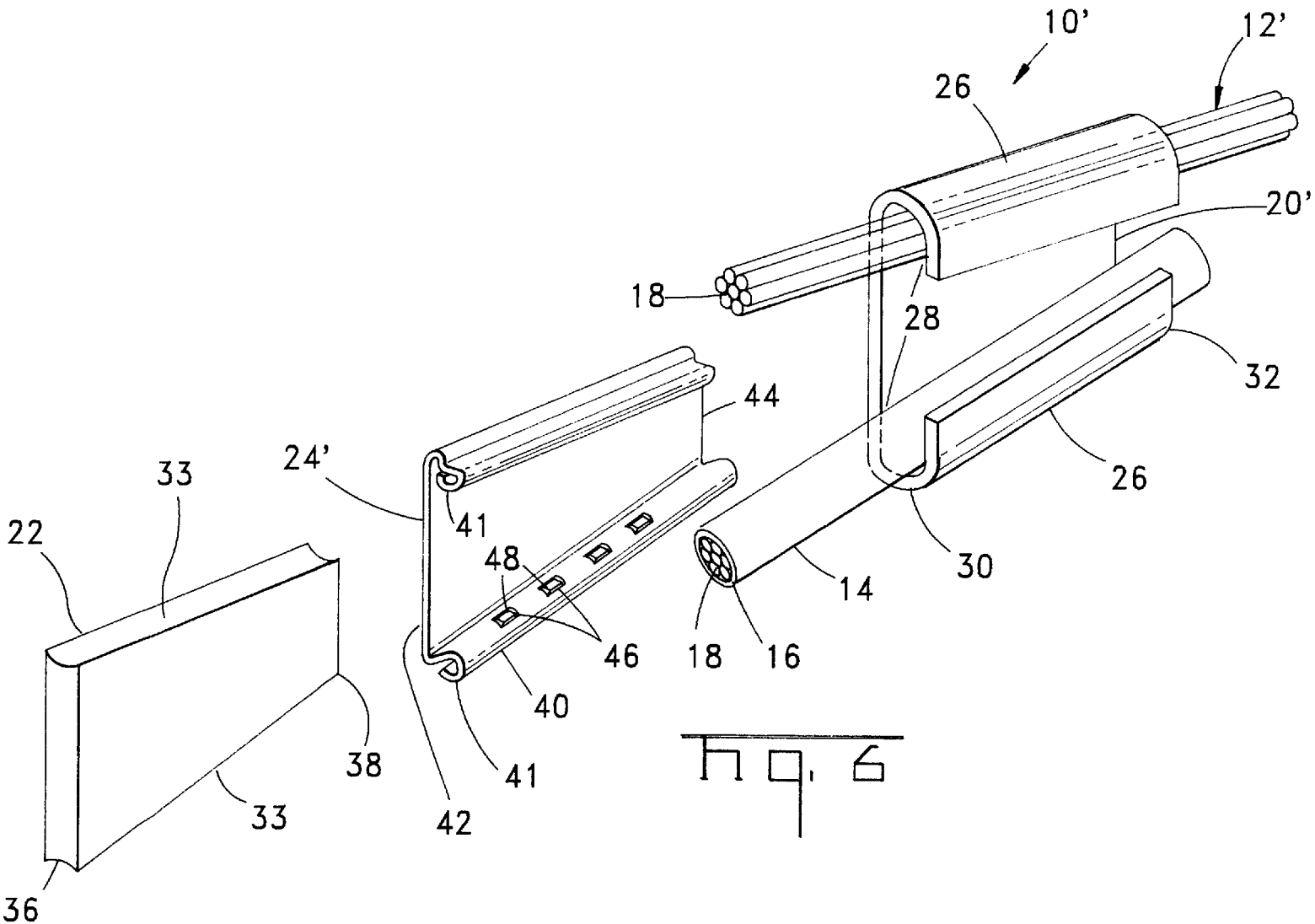
FIG. 6 is an exploded isometric view of another embodiment the electrical connector assembly of the present invention showing the connection of an insulated conductor to an uninsulated conductor.

FIG. 6 illustrates a connector assembly 10' connecting together electrically conductive conductors 12' and 14 wherein conductor 14 has an insulation covering 16 which is the same as that of FIG. 1, but conductor 12' is devoid of any insulation covering and comprises one or more uninsulated conductive cores 18. The electrical connector assembly 10' of the present invention finds utilization for existing power source that require the establishment of electrical conductivity between two electrical conductors one of which carries an insulation coating 16 and the other which is devoid of an insulation covering. The electrical connector assembly 10' comprises a receptacle element 20', a tapered element 22, and a one-piece intermediate member 24'. The receptacle element 20' is similar to the receptacle element 20' of FIG. 2, but has a different configuration of its piercing serrations 34 which may be further described with reference to FIG. 7.

Figure 7:
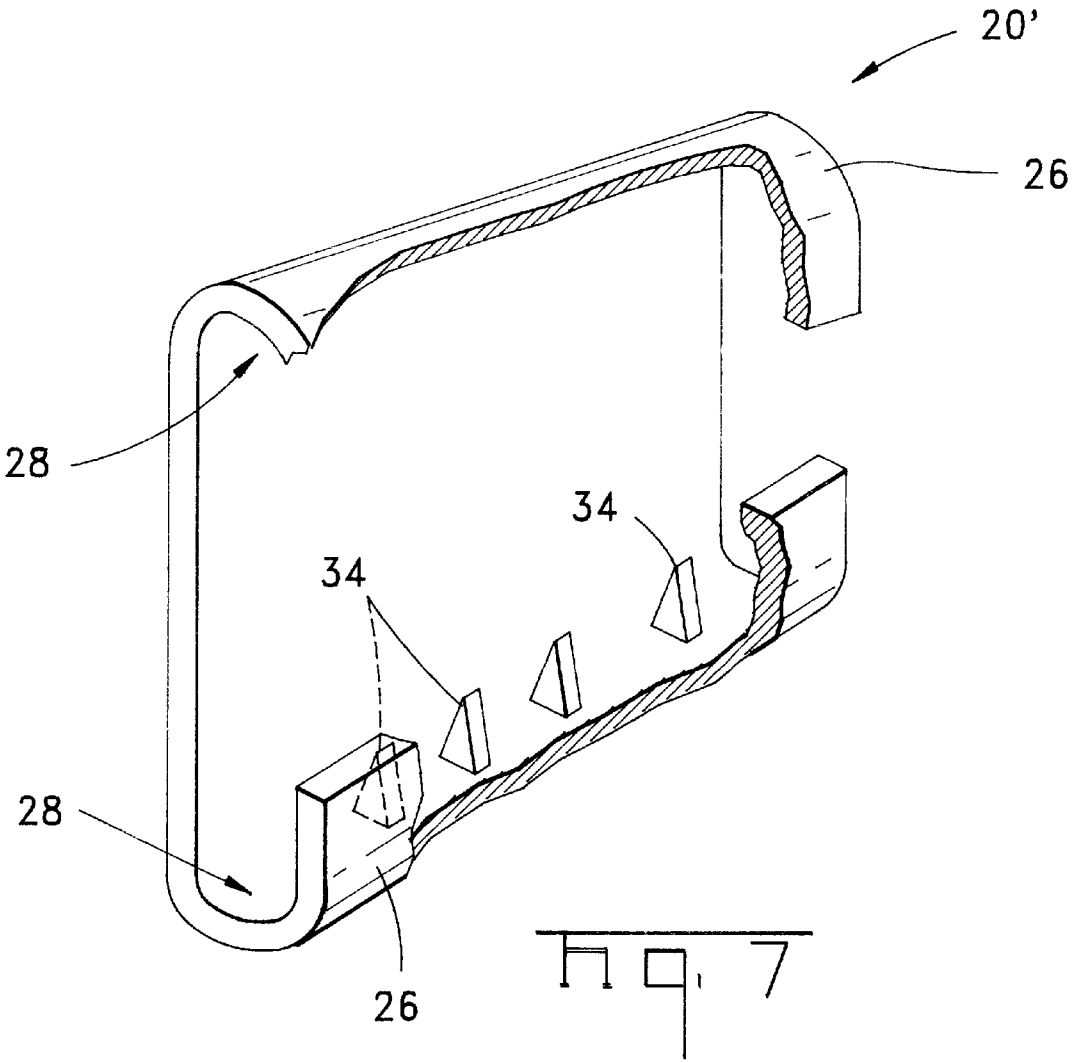
Figure 8B:
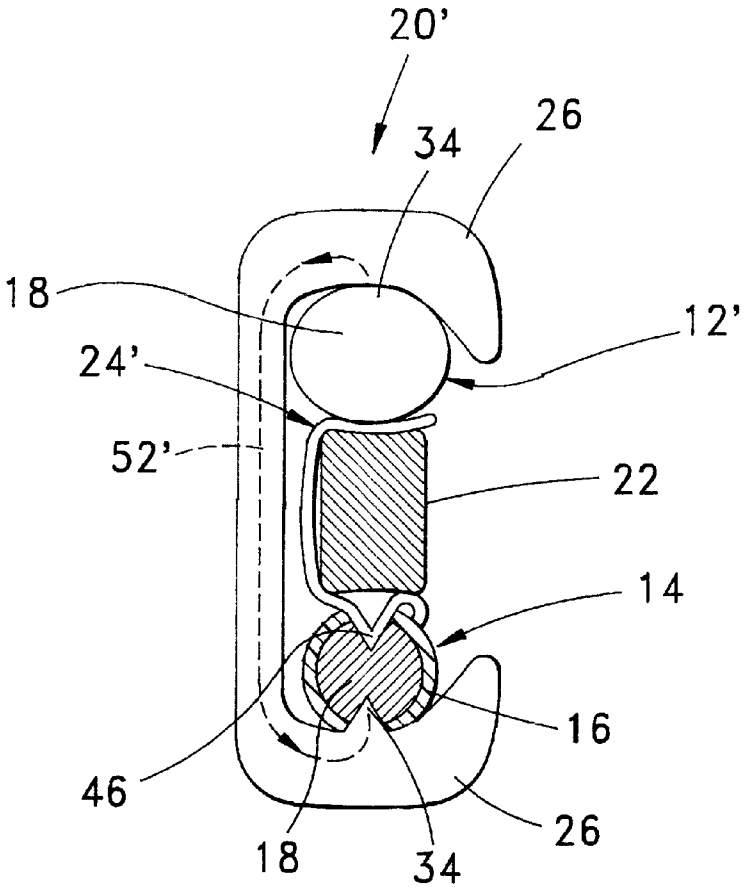
FIGS. 8(A) and 8(B), each of which illustrates a different embodiment of the receptacle element of FIG. 6 operatively cooperating with the tapered element and intermediate member for preferentially directing current flow between cables and rigidly fixing the electrical connection of the cables.

FIG. 7 illustrates the piercing serrations 34 as being located on the lower (as viewed in FIG. 7) channel 28; however, if desired and as to be further described with reference to FIGS. 8(A) and 8(B), the piercing serration 34 may be located on the upper channel 28. The piercing serrations 34 of the receptacle element 20' operatively cooperate with the piercing serrations 46 of the one-piece intermediate member 24' shown in FIG. 6.

The one-piece intermediate member 24' has all of the features and dimensions described for the intermediate member 24 (FIGS. 1–5), but only carries piercing serrations 46 and associated slots 48 on one of its lower (as viewed in FIG. 6) cable-engaging section 40; however, the piercing serrations 46 may be located on the upper cable-engaging sections 40 in a manner that may be described with reference to FIGS. 8(A) and 8(B).

Figure 8A:
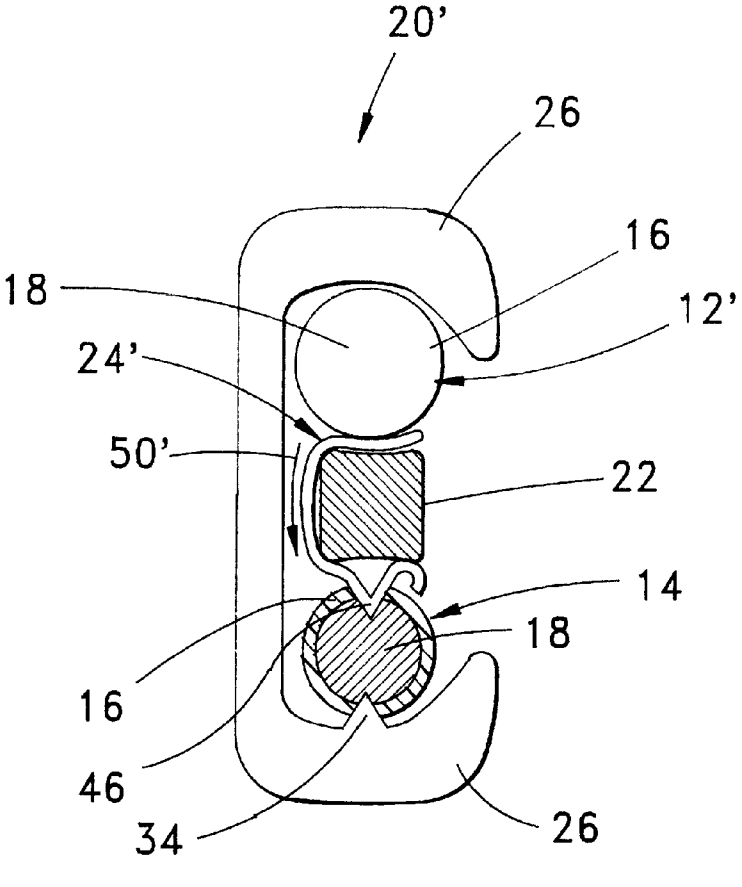

FIG. 8(A) is similar to that of FIG. 3(A) except that the receptacle element 20' of FIG. 8(A) only has piercing serrations 34 on its lower portion (as viewed in FIG. 8(A)) and, similarly, the intermediate member 24' of FIG. 8(A) only has piercing serration 46 on its lower portion (as viewed in FIG. 8(A)). Further, FIG. 8(A) illustrates an uninsulated cable 12' rather than the insulated cable 12 of FIG. 3(A). A comparison between FIG. 3(B) and FIG. 8(B) reveals the same differences of the elements as described for FIGS. 3(A) and 8(A). Both of the embodiments of FIGS. 8(A) and 8(B) capture the electrical cable between the piercing members 34 and 46 receptacle element 20' and intermediate member 24', respectively.

In a manner as already described for FIG. 3(A), in the embodiment of FIG. 8(A), electrical current need not pass through the receptacle element 20' and the tapered element 22, but rather current only needs to pass from one cable 12' to the other cable 14 by conduction only through the intermediate member 24' as indicated by the directional arrow 50'. In the embodiment of FIG. 8(A) the piercing serrations 46 of the intermediate member 24 penetrates through the conductor insulation 16 to make mechanical contact with the conductor metal body 18. This provides mechanical support directly to the metal conductor body in a manner already discussed with reference to FIG. 3(A). Further in the embodiment of FIG. 8(A), the current flowing in direction 50' may also pass through the tapered element 22 if the tapered element 22 is selected to be of an electrically conductive material.

In a manner as already described with reference to FIG. 3(B), in the embodiment of FIG. 8(B), electrical current need not pass through the intermediate member 24' and tapered element 22, but rather current only needs to pass from one cable 12' (uninsulated) to the other cable 14 (insulated) by conduction only through the receptacle element 20' as shown by directional arrow 52'. In the embodiment of FIG. 8(B) the piercing member 46 need not conduct electricity. Instead, the piercing serration 34 of the receptacle element 20' penetrates the conductor insulation 16 as to make mechanical contact with the conductor metal body 18 of cable 14, while at the same time the receptacle element 20' is in forced contact with cable 12'. The provides mechanical support directly to the metal conductor body 18 in a manner similar to that already described with reference to FIG. 3(B). In a manner already described with reference to FIGS. 3(A) and 3(B) in the embodiments of FIGS. 8(A) and 8(B) the receptacle element 20', the tapered element 22, and the intermediate member 24' may each be selected of a non-electrically conductive material or of an electrical conductive material to provide various combination, already described for FIGS. 3(A) and 3(B), that yield the flow of current in direction 50' (see FIG. 8(A)) or the flow of the current in direction 52' (see FIG. 8(B)).

In operation, the tapered element 22 has its two concave sidewalls 33 inserted under the concave cable-engaging section 40 and when the tapered element 22 receives a sufficient mechanical force, the tapered element 22 is driven into the intervening member 24' thereby causing piercing serrations 46 to pierce the electrical insulation 16 of cable 14 and into the electrically conductive slots 18 thereof. The mechanical force drives the intermediate member 24' into the uninsulated cable 12' which, in turn, is forced into the receptacle element 20'.

Further details of the operation of the intermediate member 24' having piercing serration 46 in only one of cable-engaging section 40 are similar to the operation already described with reference to FIG. 4. Similarly, the formation of the intermediate member 24' is similar to the method already described with reference to FIGS. 5(A)–5(E), except that the plate 56 of FIG. 5(B) is used in FIGS. 5(C), 5(D) and 5(E), rather than the plate 56 of FIG. 5(A). More particularly, the bending steps of FIGS. 5(D) and 5(E) to provided for the insertion of the serrations 46 into the slots 48 is only performed on the left section (as viewed in FIGS. 5(D) and 5(E)) of the plate 56 of FIG. 5(B) and the right section as viewed in FIGS. 5(D) and 5(E)) of the plate 56 of FIG. 5(B) is only provided with two bends 66 and 70 so as to form a concave section between regions 68 and 72 already described with reference to FIG. 5(E).

It should now be appreciated that the practice of the present invention provides an uncomplicated fabrication process for implementing the one-piece intermediate member 24 of the present invention.

What we claim is:

1. An electrical connector assembly for connecting electrical conductors with at least one conductor having an insulated covering and containing an electrically conductive core, said electrical connector comprising:

a) a receptacle element which has two ears that define channels for partially enclosing respectively said electrical conductors;

b) a tapered element provided with two side walls that are dimensioned to be inserted between said two ears of said receptacle element; and c) an intermediate member dimensioned to be situated between said receptacle element and said tapered element and having oppositely disposed cable engaging sections with edges which are dimensioned so as to be complementary to and capable of accepting edges of said tapered element, said intermediate member being a one-piece member having integral movable sections disposed inwardly from said cable-engaging sections, at least one cable engaging section having at least one piercing member and at least one slot arranged in parallel with and in alignment with said at least one piercing member, said movable sections of said intermediate member being folded so that said at least one piercing member fits into said at least one slot, said piercing member being suitable for piercing said electrical insulating covering and making electrical contact with at least one of said electrically conductive cores.

2. The electrical connector assembly according to claim 1, wherein said receptacle element further comprises at least one piercing member located along at least one of the channels.

3. The electrical connector assembly according to claim 2, wherein said piercing members of said receptacle element and of said intermediate member are in near alignment with each other when said intermediate member is situated between said receptacle element and said tapered element.

4. The electrical connector assembly according to claim 2, wherein said receptacle element and said intermediate member each comprise an electrically conductive material.

5. The electrical connector assembly according to claim 2, wherein said receptacle element comprises an electrical conductive material and said intermediate member comprises an electrically insulative material.

6. The electrical connector assembly according to claim 2, wherein said receptacle element comprises an electrically insulative material and said intermediate member comprises an electrically conductive material.

7. The electrical connector assembly according to claim 6 wherein said tapered element comprises an electrically conductive material.

8. The electrical connector assembly according to claim 6 wherein said tapered element comprises an electrically insulative material.

9. The electrical connector assembly according to claim 1, wherein all of the electrical conductors have an insulated covering and wherein each of the cable-engaging sections has at least one piercing member and at least one slot arranged in parallel with and in alignment with at least one piercing member.

* * * * *